US008382090B2

(12) United States Patent
Sasamoto et al.

(10) Patent No.: US 8,382,090 B2
(45) Date of Patent: Feb. 26, 2013

(54) POST-PROCESSING SYSTEM

(75) Inventors: Shinya Sasamoto, Hokuto (JP); Hideki Orii, Minamialps (JP); Akihiko Tsukui, Kai (JP); Shotaro Kikushima, Misato (JP)

(73) Assignee: Nisca Corporation, Minamikoma-Gun, Yamanashi (JP)

( * ) Notice: Subject to any disclaimer, the term of this patent is extended or adjusted under 35 U.S.C. 154(b) by 0 days.

(21) Appl. No.: 13/064,464

(22) Filed: Mar. 28, 2011

(65) Prior Publication Data

US 2011/0233841 A1 Sep. 29, 2011

(30) Foreign Application Priority Data

Mar. 29, 2010 (JP) ..... 2010-074973

(51) Int. Cl.
*B65H 37/04* (2006.01)

(52) U.S. Cl. ..... 270/58.07; 270/58.08; 270/58.09

(58) Field of Classification Search ..... 270/58.07, 270/58.08, 58.09
See application file for complete search history.

(56) References Cited

U.S. PATENT DOCUMENTS 5,640,232 A * 6/1997 Miyake et al. ..... 399/18
7,407,156 B2 * 8/2008 Iizuka et al. ..... 270/58.11

FOREIGN PATENT DOCUMENTS

JP 2007-062202 3/2007
JP 2009-073048 4/2009

* cited by examiner

*Primary Examiner* — Leslie A Nicholson, III
(74) *Attorney, Agent, or Firm* — Manabu Kanesaka

(57) ABSTRACT

To provide a post-processing system for enabling a sheet prepared in a different printing apparatus to be mixed and undergo post-processing when the post-processing apparatus performs bookbinding finish on sheets with images formed thereon, a collecting means is provided in a post-processing section for performing post-processing on image-formed sheets, and is configured to enable a bunch of sheets to be manually set from the outside, a control section is provided with operating means for outputting a set finish signal such that the sheets have been set manually in the collecting means, and it is configured when a mode selecting means selects a mixing post-processing mode, the control section performs the post-processing on a bunch of sheets by post-processing means using the set finish signal from the operating means.

8 Claims, 8 Drawing Sheets

POST-PROCESSING SYSTEM

RELATED APPLICATIONS

The present application is based on, and claims priority from Japanese Applications No. 2010-074973 filed Mar. 29, 2010, the disclosure of which is hereby incorporated by reference herein in its entirety.

BACKGROUND OF THE INVENTION

The present invention relates to a post-processing system for mixing and collecting sheets with images formed in an image forming section and a sheet inserted from the outside in a collecting section to perform post-processing on the bunch of sheets.

Generally, this type of post-processing system is comprised of an image formation apparatus and a post-processing apparatus (finisher) coupled to the downstream side of the image formation apparatus, and is known as a system in which the post-processing apparatus collates and collects sheets with images formed in the image formation apparatus to perform post-processing such as binding processing and bookbinding processing, and stores the sheets in a storage stacker. Then, the stapler unit is known as the binding processing means, and the bookbinding unit is known as the bookbinding processing.

For example, Patent Document 1 proposes a system in which a bookbinding apparatus is disposed downstream of an image formation apparatus, and a post-processing apparatus is disposed downstream of the bookbinding apparatus, and the system is configured so that the post-processing apparatus collates and collects sheets with images formed in the image formation apparatus on the upstream side, applies an adhesive to the bunch of sheets, and covers the bunch with a front-cover sheet for cover bookbinding. In the apparatus in the Document, the Document discloses the configuration in which the apparatus collates the image-formed sheets, and transfers the sheets to an adhesive application position using a job finish signal of image formation to perform the bookbinding processing.

Meanwhile, Patent Document 2 discloses a bookbinding apparatus which sets a bunch of sheets, which are collated from the outside, in a sheet collection portion (tray), and transfers the bunch to an adhesive application position using a set finish signal to perform the bookbinding processing. It is disclosed in Document 2 that the bookbinding apparatus is disposed alone (standalone), an operator sets a bunch of sheets printed outside in a tray provided in the bookbinding apparatus, and that the bookbinding apparatus applies an adhesive using the set finish signal, and performs cover fastening.

[Patent Document 1] Japanese Patent Application Publication No. 2007-62202 (FIG. 1)

[Patent Document 2] Japanese Patent Application Publication No. 2009-73048 (FIG. 1)

As described above, the system is known in Patent Document 1 and the like in which the sheets with images formed in the image formation apparatus are collated and collected in bunch form in the post-processing apparatus provided on the downstream side, and the bunch of sheets undergoes bookbinding. Further, the apparatus is known in Patent Document 2 and the like which performs bookbinding processing on a bunch of sheets that are printed by the outside printing method and that are collated.

However, in the image formation system comprised of the image formation apparatus and post-processing apparatus, it is not possible that part of a series of document sheets are generated in the image formation apparatus, and that the post-processing apparatus adds a sheet generated by another printing method to the sheets to mix for bookbinding finish. Accordingly, it is considered impossible that a sheet subjected to special printing such as, for example, gravure printing, glossy printing and hologram printing is mixed to sheets generated in the image formation apparatus, sheets are collated, and that bookbinding is performed on the bunch of sheets.

For such mixing of an external document sheet, it is required that the sheet is mixed as a prior page, subsequent page, or middle page of sheets generated in the image formation apparatus, but it is impossible to meet any requirements in the conventional system.

Therefore, the inventor of the invention reached the idea of providing a "mixing post-processing mode" in the post-processing system comprised of the image formation apparatus and post-processing apparatus, and configuring so that the post-processing operation is started using an operation signal of an operator in this mode. It is thereby possible to mix an external document sheet as a prior page, subsequent page, or middle page and perform bookbinding finish.

In the invention, it is an object to provide a post-processing system for enabling a sheet prepared in a different printing apparatus to be mixed and undergo post-processing when the post-processing apparatus performs bookbinding finish on sheets with images formed in the image formation apparatus.

BRIEF SUMMARY OF THE INVENTION

To attain the above-mentioned object, in the invention, a post-processing section for performing post-processing on image-formed sheets is provided with a collecting means, the collecting means is configured to enable a bunch of sheets to be manually set from the outside, and a control section is provided with an operating means for outputting a set finish signal such that the sheets have been set manually in the collecting means. Then, the invention is characterized in that when a mixing post-processing mode is selected in a mode selecting means, the control section is configured to perform post-processing on a bunch of sheets by a post-processing means using the set finish signal from the operating means.

Further, the specific configuration will specifically be described. Provided is a post-processing system having an image forming section that forms an image on a sheet, a post-processing section that performs post-processing on sheets with images formed thereon, and a control section that controls the post-processing of sheets, and the post-processing section is provided with a collecting means for setting the sheets in bunch form, a sheet transport means for carrying the sheet with the image formed in the image forming section to the collecting means, a post-processing means for performing the post-processing on the bunch of sheets set in the collecting means, and a stack means for holding the bunch of sheets subjected to the post-processing. The collecting means is configured to enable a bunch of sheets with images formed to be manually set from the outside.

Further, the above-mentioned control section is provided with a mode selecting means for selecting an automatic post-processing mode in which the post-processing section performs the post-processing on sheets with images formed in the image forming section, or a mixing post-processing mode in which the post-processing section performs the post-processing on a bunch of mixed sheets of the sheet sent to the collecting means from the image forming section and a manually set sheet, and with an operating means for outputting a set finish signal such that the sheet has manually been set in the collecting means. Then, the control section is configured to perform the post-processing on the bunch of sheets in the post-processing means using the job finish signal from the image forming section when the mode selecting means selects the automatic post-processing mode, while performing the post-processing on the bunch of sheets in the post-processing means using the set finish signal from the operating means when the mode selecting means selects the mixing post-processing mode.

The invention configures the collecting means for collating and collecting image-formed sheets to enable a bunch of sheets to be manually set from the outside, provides the operating means for outputting a set finish signal such that the sheet has manually been set, performs the post-processing on a bunch of sheets in the post-processing means using the set finish signal from the operating means in the mixing post-processing mode, and therefore, has the effect as described below.

When sheets with images formed in the image formation apparatus are collated and collected in the collecting means of the post-processing apparatus, it is possible to mix a sheet generated in another printing apparatus to the front, back or middle of the sheets, and it is thus possible to perform post-processing such as bookbinding and file punching with the sheet subjected to special printing such as, for example, gravure printing mixed. Therefore, as compared with the conventional case where a plurality of kinds of sheets printed in individual image formation apparatuses are collated by manual operation, and the bunch of sheets is subjected to post-processing in a post-processing apparatus of the standalone (offline) configuration, it is possible to perform the post-processing operation efficiently. Concurrently therewith, the utilization scope of the system becomes wide.

Further, the invention provides a manual post-processing mode for performing the post-processing on a bunch of sheets manually set in the collecting means in the post-processing section, in addition to the automatic post-processing mode for performing online processing in the image formation apparatus and post-processing apparatus and the mixing post-processing mode, and is thereby capable of further widening the utilization scope (processing specifications) of the system apparatus.

BRIEF DESCRIPTION OF THE SEVERAL VIEWS OF THE DRAWINGS

FIG. 4 (*b*) is an explanatory view of a front page insertion state; FIG. 4 (*c*) is an explanatory view of a back page insertion state; FIG. 4(*d*) is an explanatory view of a middle page insertion state;

FIG. 6(*b*) shows a post-processing means (adhesive coating means);

DETAILED DESCRIPTION OF THE INVENTION

Figure 1:
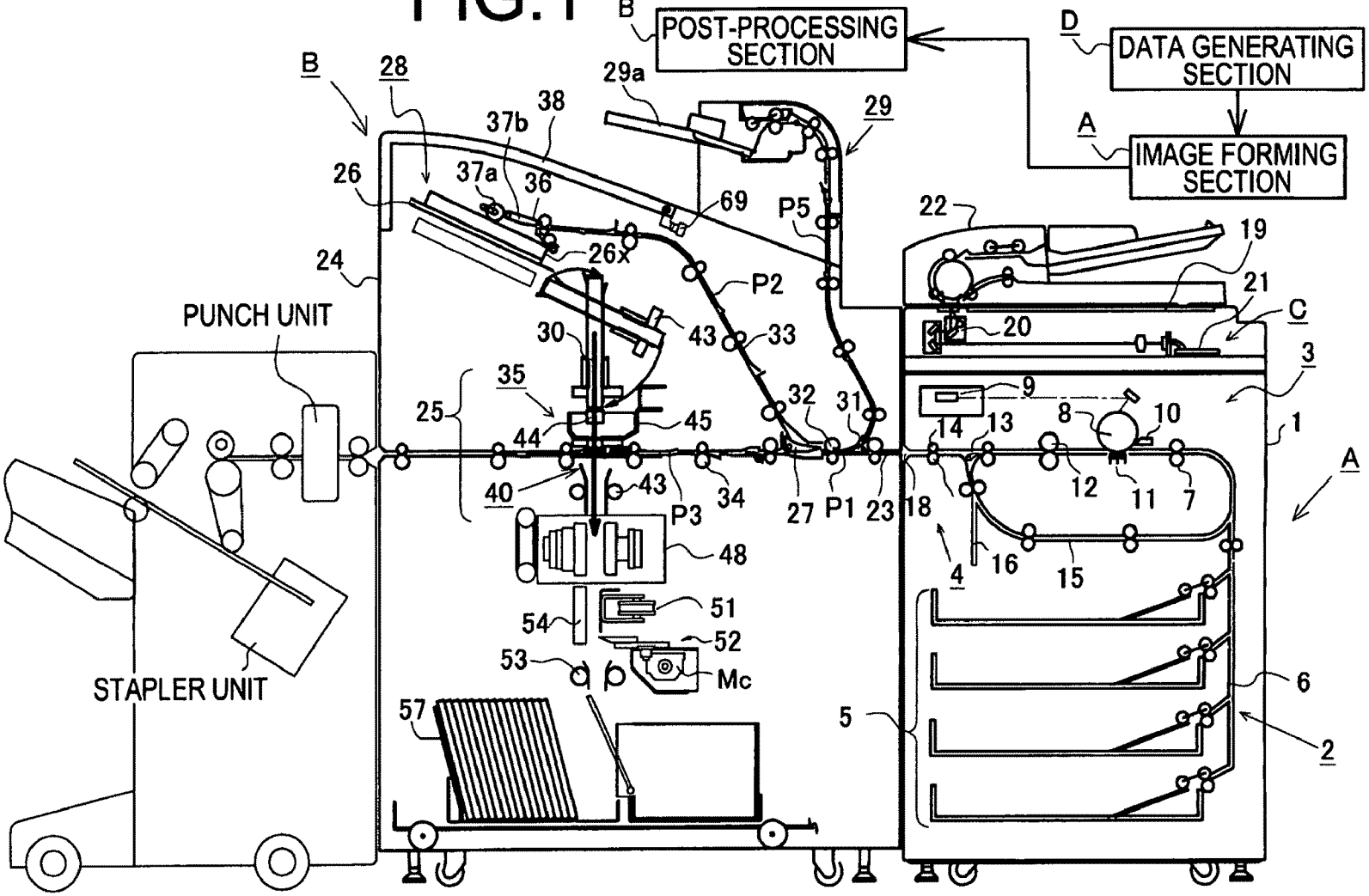
FIG. 1 is an entire configuration diagram of a post-processing system according to the invention.

As shown in FIG. 1, a post-processing system of the invention is comprised of an image forming section A that forms an image on a sheet, and a post-processing section B that collates and collects sheets sent from the image forming section to perform post-processing. Then, image data is transferred to the image forming section A from a document read section C configured integrally with the section A. Concurrently therewith, image data is transferred from a data generating section D such as a computer. Then, the image forming section A forms an image on a sheet based on the image data transferred from the document read section C or data generating section D, and carries the sheet sequentially out of a sheet discharge outlet 18.

The post-processing section B collates and collects the image-formed sheets as a set, and binds the bunch of sheets or forms filing holes using a finish signal of image formation. Therefore, the post-processing section B is provided with a bookbinding processing mechanism for binding the bunch of sheets with a front-cover sheet as described later, a binding processing mechanism for stapling the bunch of sheets, or a punching mechanism for punching filing holes in the bunch of sheets.

[Configuration of the Post-Processing System]

The post-processing system as shown in FIG. 1 is comprised of the image forming section A and the post-processing section B, and the image forming section A is integrally provided with the document read section C as a unit, and is further coupled to a computer or the like so that data transfer is performed with the data generating section D. Then, as FIG. 2(*a*) shows the system configuration, the post-processing system of FIG. 1 is configured so that the data generating section D transfers document data to the image forming section A, and that the sheet prepared in the image forming section A is carried to the post-processing section B.

Further, the document data is transferred to the image forming section A from the image read section C, and the image read section C is configured as a scanner unit integrally formed in the image forming section A as shown in FIG. 1, or a network scanner. Then, the data generating section D transfers control data (size information of the document data, etc.) to a control section 60 that controls the image forming section A and the post-processing section B. For the control section 60, in the post-processing system in FIG. 1, the image forming section A is provided with an image formation control section 61, the post-processing section B is provided with a post-processing control section 65, and both of the control sections 61 and 65 are connected to mutually transfer control data.

The post-processing section B is provided with post-processing means 25 such as a bookbinding processing mechanism, binding processing mechanism and punching mechanism, the configuration will be described below, and a collecting means (collection tray) 26 is provided on the upstream side of the post-processing means 25. Then, the collecting means 26 is comprised of a tray for loading sheets in bunch form, and is configured so that a user (operator) sets a bunch of sheets generated outside in the means 26 concurrently with sheets sent from the image forming section A being carried out to the tray and collected thereon.

This bunch of sheets generated outside is specially printed sheets such as sheets with images formed by a printing means (method) different from that in the image forming section A, and is prepared by the user. Expected as such specially printed sheets are sheets that cannot be printed in the image forming section A which is incorporated into the system, such as gravure printing, hologram printing and photograph printing, or a number of printed document sheets.

[Configuration of the Control Section]

The invention is characterized by selectively setting the post-processing mode in the post-processing system at "automatic post-processing mode Mo1", "manual post-processing mode Mo2" or "mixing post-processing mode Mo3" corresponding to the printing conditions of a bunch of sheets to collate and collect.

In addition, in the invention, the "automatic post-processing mode Mo1" is an operation mode in which the post-processing section B successively performs the post-processing on sheets with images formed in the image forming section A without the operator operating. Further, the "manual post-processing mode Mo2" is an operation mode in which the post-processing section B performs the post-processing on a bunch of sheets that is manually set in the collecting means 26. Furthermore, the "mixing post-processing mode Mo3" is an operation mode in which the post-processing section B performs the post-processing on a bunch of mixed sheets of a bunch of sheets of which images are formed in the image forming section A and which are collected in the collecting means 26, and a manually set sheet.

Figure 2A:
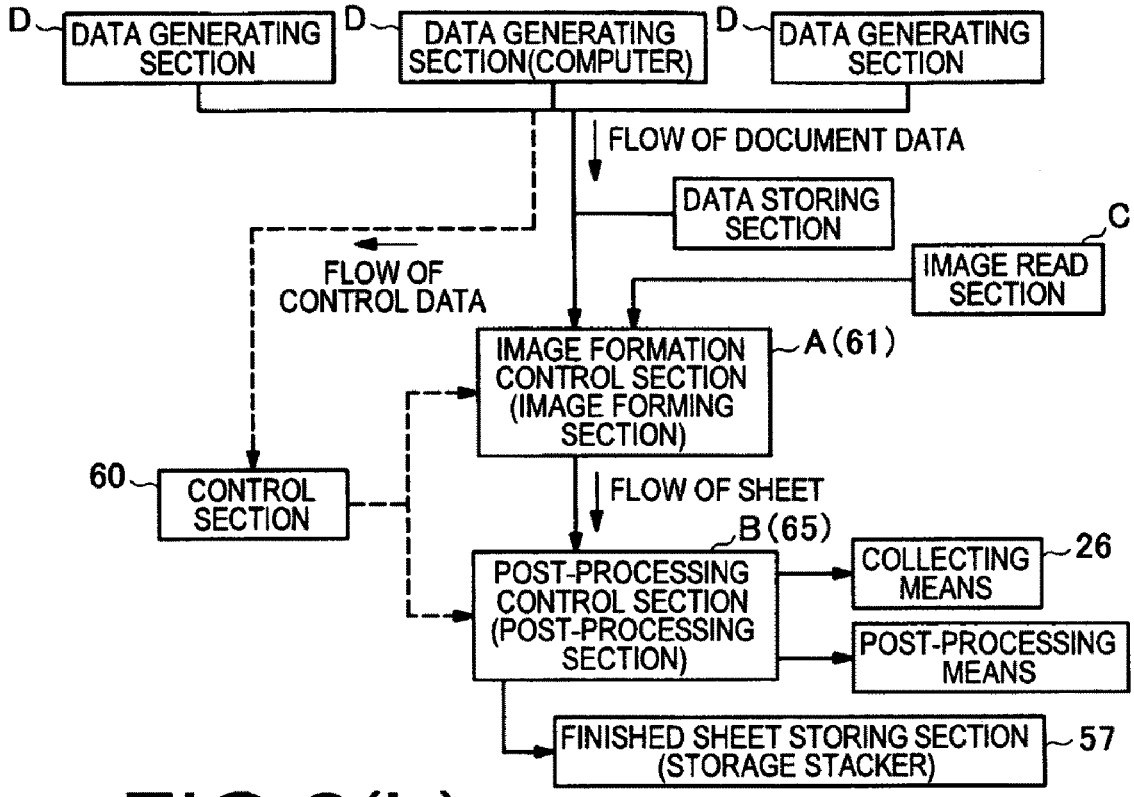
FIG. 2(*a*) shows a configuration of the post-processing system, FIG. 2 (*b*) is an explanatory view of a configuration of a control section.
Figure 2B:
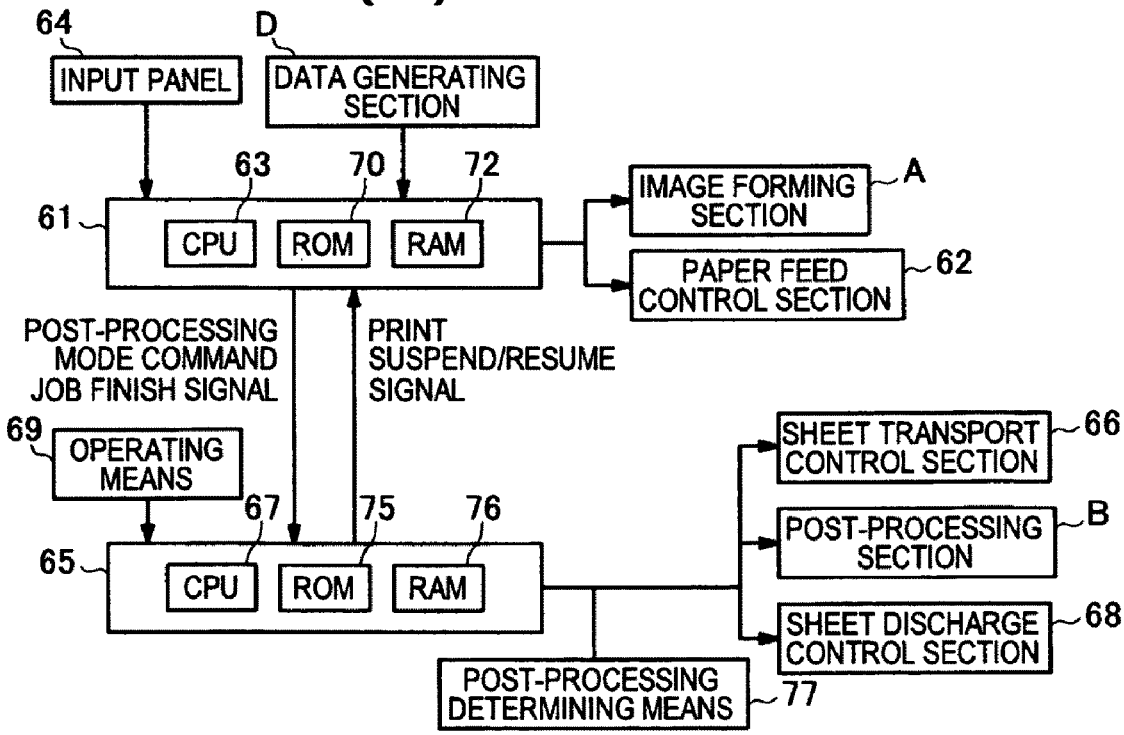

FIG. 2 shows a configuration of the control section 60. The image forming section A is provided with the image formation control section 61, and the post-processing section B is provided with the post-processing control section 65. The image formation control section 61 is comprised of a control CPU 63, and formed of a paper feed control section 62, image forming section A and input panel 64. The paper feed control section 62 controls sheet feeding for feeding a designated sheet to a printing section 3 from a cassette 5, and the image forming section A controls the printing section 3 that forms an image on the fed sheet.

Then, the input panel 64 is to designate, image formation conditions such as, for example, color/monochrome printing type, scaling factor setting, and two/one side printing. Further, the input panel 64 is configured to set the post-processing mode Mo. The image formation control section 61 is provided with ROM 70 for storing control programs, and RAM 72 for storing control data. In this case, the setting means of the post-processing mode is comprised of the input panel 64 provided in the image formation control section 61, and the post-processing control section 65 may be provided with the setting means of the post-processing mode, such as an input panel.

The post-processing control section 65 is comprised of a control CPU 67, and controls each of a sheet transport control section 66, post-processing determining means 77 and sheet discharge control section 68 in the post-processing section B. The specific configuration will be described in Embodiments described later. Then, the post-processing control section 65 is provided with an operating means 69 for outputting a set finish signal such that a sheet has manually been set in the collecting means (collection tray) 26. The operating means 69 is comprised of a button switch or switching means (actuating sensor SS1 described later) that operates in conjunction with manual setting of a sheet such as an open/close cover. The post-processing section 65 is provided with ROM 75 for storing control programs, and RAM 76 for storing control data.

Figure 3:
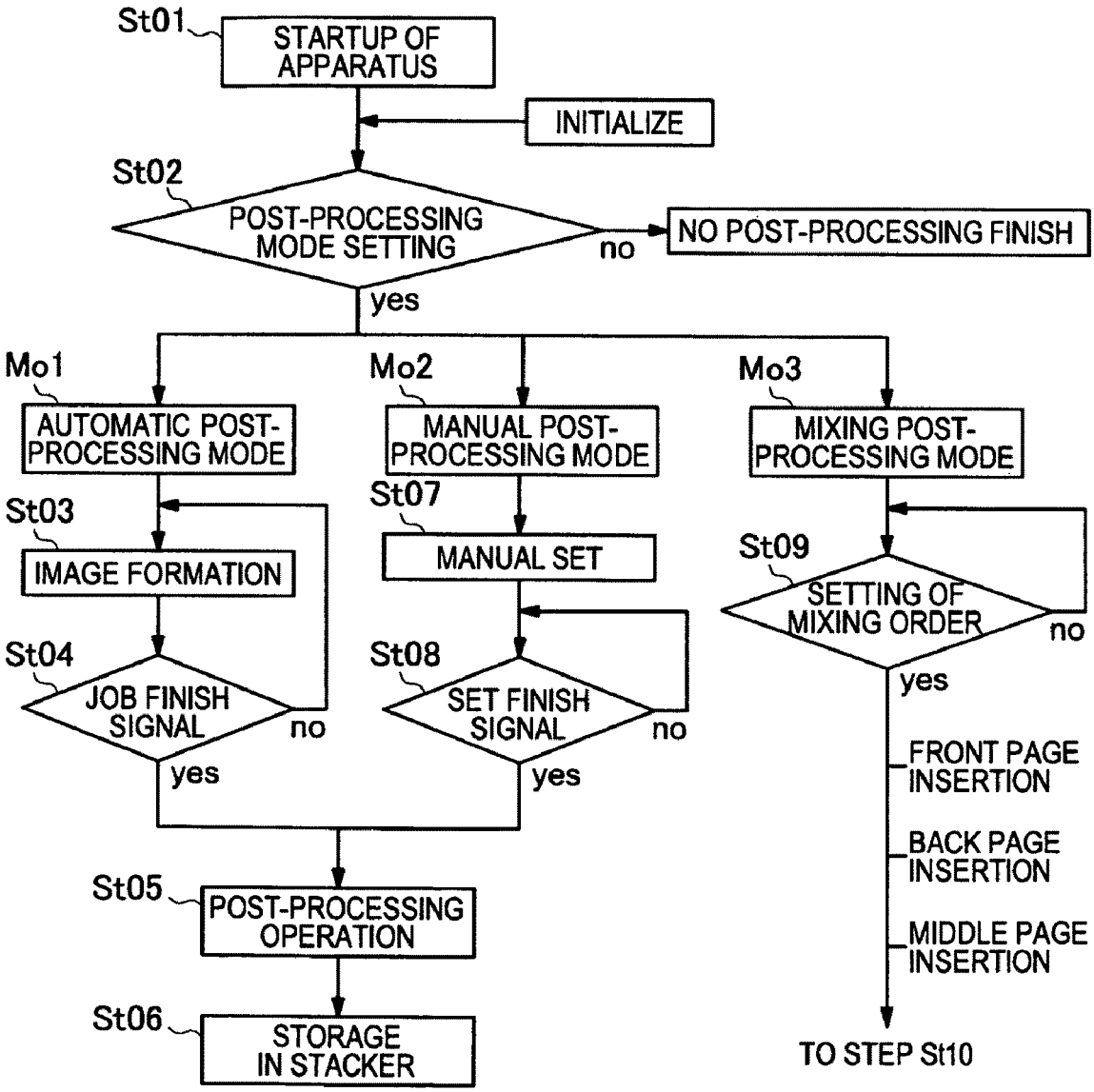
FIG. 3 is an operation flow of a post-processing mode in the invention.

Then, the post-processing mode Mo will be described according to FIG. 3. In starting the apparatus, the image forming section A and the post-processing section B are initialized and started, and the apparatus is set for the initial state (St01). Then, an operator sets the image formation conditions and post-processing mode Mo from the input panel 64 (St02). When the mixing post-processing mode Mo3 is set as the post-processing mode, the mode setting means (the input panel as described previously; the same in the following description) is configured to set the mixing order of sheets (see St09). The setting of the mixing order is set at one of front page insertion Mo3*a*, back page insertion Mo3*b* and middle page insertion Mo3*c*.

Based on FIG. 3, described below is the control operation when the "automatic post-processing mode Mo1" is set in the post-processing mode setting (St02). The control section 60 outputs a print start signal to the image forming section A, and the image forming section A forms images on sheets (St03). Then, when image formation is finished, a print job finish signal (hereinafter, referred to as a job finish signal) is transferred to the post-processing control section 65 (st04). Upon receiving the job finish signal, the post-processing section performs the post-processing operation (St05), and stores the sheets in a storage stacker (St06).

Based on FIG. 3, described below is the control operation when the "manual post-processing mode Mo2" is set in the post-processing mode setting (St02). The post-processing control section 65 waits until a sheet bunch is manually set in the collecting means (collection tray) 26 and the operating means 69 issues a set finish signal (St07). Then, upon receiving the set finish signal (St08), the section executes the post-processing operation (St05), and stores the bunch in the storage stocker (St06).

Based on FIGS. 3 and 4(*a*), described below is the control operation when the "mixing post-processing mode Mo3" is set in the post-processing mode setting (St02). At this time, the control section 60 urges an operator to input the setting of the mixing order in the input panel 64, concurrently with the setting of the post-processing mode. The mixing order is set from the input panel 64 (St09). As the setting of the mixing order, "front page insertion", "back page insertion" or "middle page insertion" is selectively set (see FIG. 3).

When the "front page insertion Mo3*a*" is selected in the setting of the mixing order, as shown in FIG. 4(*b*), a manual insertion sheet SI is first set in the collecting means 26, and sheets So from the image forming section A are loaded and stored on the insertion sheet SI. Then, when the front page insertion mode Mo3*a* is set, the post-processing control section 65 issues a signal for suspending printing to the image forming section A, and waits until a bunch of sheets is manually set in the collecting means (collection tray) 26 (St10) and the operating means 69 issues a set finish signal.

Then, upon receiving the set finish signal (St11), the control section 60 issues a print start signal to the image forming section A. Upon receiving the signal, the image formation control section 61 forms images on sheets in the image forming section A (St12). Then, when image formation is finished, the section 61 transfers a print job finish signal to the post-processing control section 65 (St13). Upon receiving the job finish signal, the post-processing section B executes the post-processing operation (St14), and stores the sheet bunch in the storage stacker (St15).

Further, when the "back page insertion Mo3*b*" is selected in the setting of the mixing order, as shown in FIG. 4(*c*), sheets So from the image forming section A are first loaded and stored in the collecting means 26, and a manual insertion sheet SI is set on the sheets. Then, when the back page insertion mode Mo3*b* is set, the image formation control section 61 forms images on sheets in the image forming section A (St16). Then, when image formation is finished, the section 61 transfers a print job finish signal to the post-processing control section 65 (St17).

Upon receiving the job finish signal, the post-processing control section 65 waits until a sheet bunch is manually set in the collecting means (collection tray) 26 (St18) and the operating means 69 issues a set finish signal (St19). Then, upon receiving the set finish signal (St19), the post-processing operation is executed (St14), and the sheet bunch is stored in the storage stacker (St15).

Furthermore, when the "middle page insertion Mo3*c*" is selected in the setting of the mixing order, as shown in FIG. 4(*d*), sheets So1 from the image forming section A are loaded and stored in the collecting means 26, and a manual insertion sheet SI is set on the sheets. After setting the sheet is finished, sheets So2 from the image forming section A are further stacked.

Then, when the middle page insertion mode Mo3*c* is set, the image formation control section 61 forms images on sheets in the image forming section A (St20). During the process of image formation, when the operating means 69 is actuated (the open/close cover 38 described later is opened), the post-processing control section 65 issues a print suspend signal to the image forming section, and the image forming section A suspends image formation by the signal (St21).

Then, the post-processing control section 65 waits until a sheet bunch is manually set in the collecting means (collection tray) 26 (St22) and the operating means 69 issues a set finish signal. Then, upon receiving the set finish signal, the post-processing control section 65 issues a print resume signal to the image forming section A (St23). Upon receiving this signal, the image formation control section 61 forms images on sheets in the image forming section A (St24). Then, when image formation is finished, the section 61 transfers a print job finish signal to the post-processing control section 65 (St25). Upon receiving the job finish signal, the post-processing section B executes the post-processing operation (St14), and stores the sheet bunch in the storage stacker (St15).

Thus, when the front page insertion Mo3*a* is set, the post-processing control section 65 stores an actuation signal of the operating means 69. Then, when the post-processing control section 65 receives a print job finish signal from the image formation control section 61 (AND condition of both signals), the section 65 executes the post-processing operation. Meanwhile, when the back page insertion MO3*b* is set, the post-processing control section 65 stores a print job finish signal from the image formation control section 61. Then, when the section 65 receives an actuation signal of the operating means 69 (AND condition of both signals), the section 65 executes the post-processing operation.

Alternately, when the middle page insertion Mo3*c* is set, the post-processing control section 65 stores a print suspend signal and a set finish signal from the operating means 69. Then, when the section 65 receives a print job finish signal from the image formation control section 61, the section 65 executes the post-processing operation. Therefore, the post-processing control section 65 is provided with the storing section (RAM) 76 for storing the "mixing order setting data", "print job finish signal" and "actuation signal of the operating means", and a post-processing determining means 77 for determining the start of the post-processing operation (see FIG. 2(*b*)).

[Configuration of the Operating Means]

Figure 5:
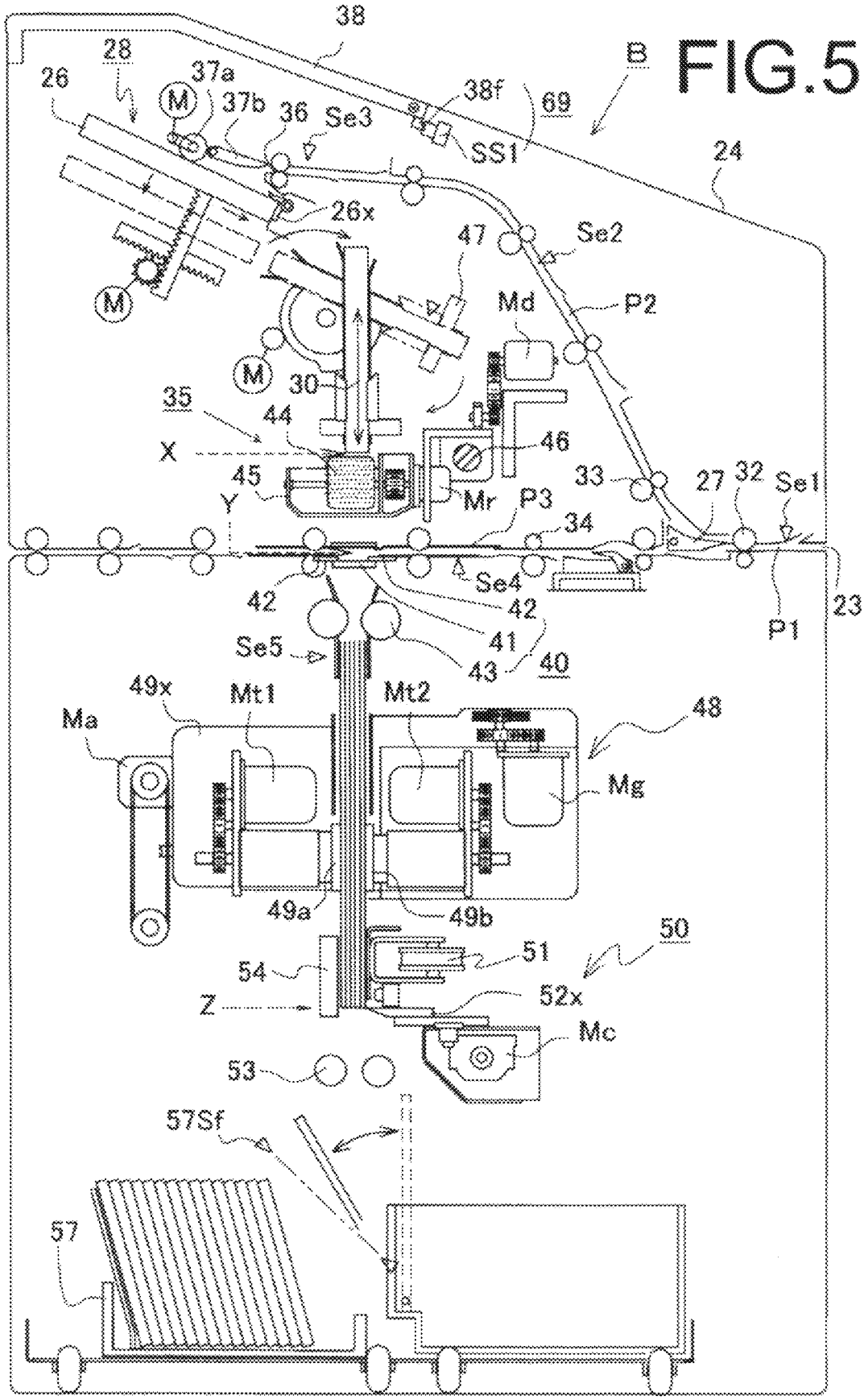
FIG. 5 is an explanatory view of a configuration of a post-processing section in the apparatus of FIG. 1.
Figure 6A:
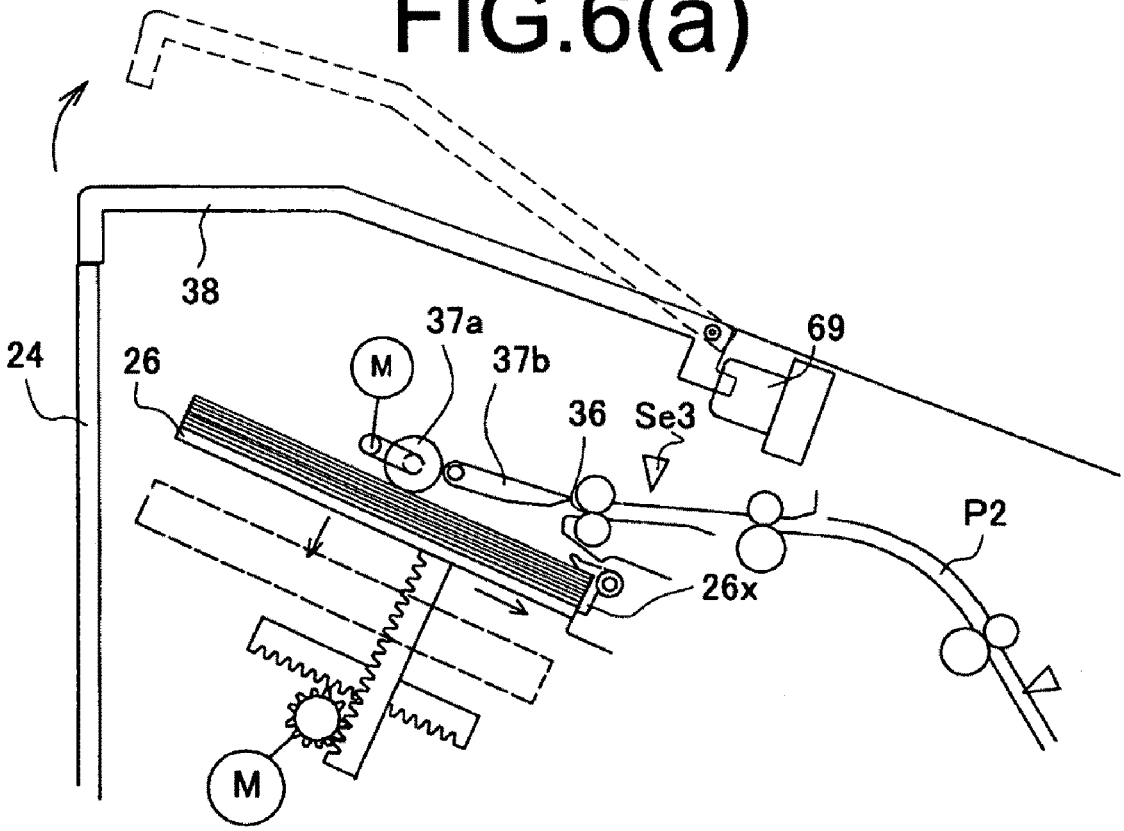
FIG. 6(*a*) shows a configuration of a collecting section.
Figure 6B:
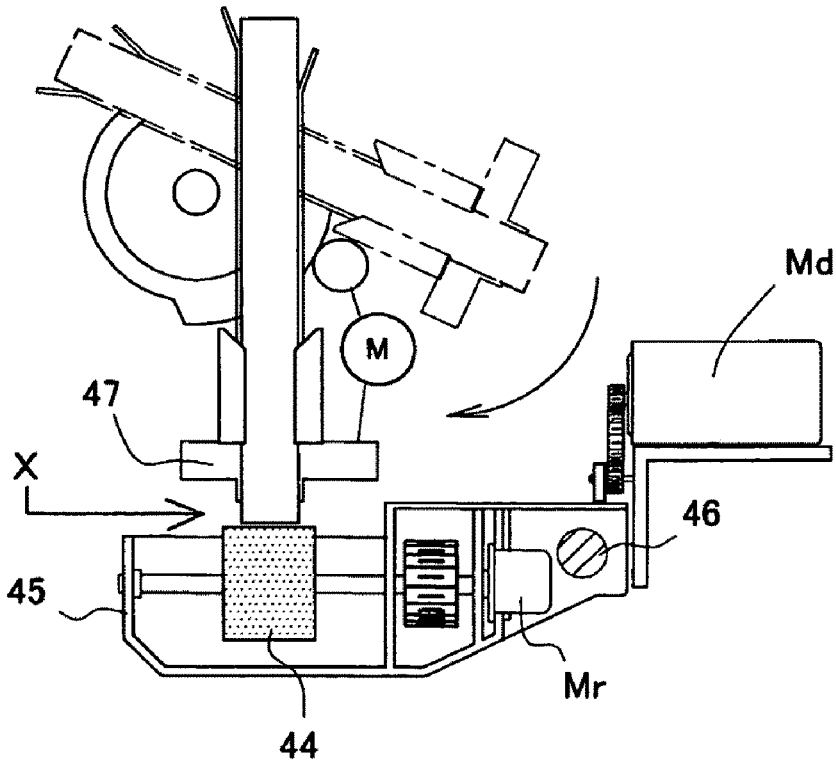

The above-mentioned collection tray 26 is provided with the open/close cover 38 to be able to open and close as shown in FIG. 5. The open/close cover 38 is provided with the operating means 69. The operating means 69 as shown in the figure is comprised of a detection sensor (in the figure, which is a photosensor) SS1 that is actuated by the operation of opening and closing the open/close cover 38, and a flag 38*f* integrally formed in the open/close cover 38, and thus is formed of the actuation sensor that is switched by the operation of opening and closing the open/close cover.

Accordingly, when the detection sensor is changed from the ON state to OFF state, the open/close cover 38 is in the open state. Meanwhile, when the sensor is changed from OFF to ON, the open/close cover 38 is in the close state. Therefore, when the open/close cover 38 is changed from the close state to open state during image formation in the image forming section A, it is determined that the operator requires manual setting, and it is possible to suspend image formation in the image forming section A.

Concurrently therewith, when the open/close cover 38 is changed from the open state to close state, it is made possible to issue a set finish signal such that the operator has set a manual insertion sheet SI on the collection tray 26. Alternately, as the operating means 69, for example, an operation switch may be provided so that the operator operates ON/OFF of the switch.

[Image Forming Section]

FIG. 1 shows the image forming section A and the post-processing section B. First, the image forming section A forms an image on a sheet by an image formation scheme such as electrostatic printing, ink jet printing, and offset printing, and carries the sheet out of the sheet discharge outlet 18. The post-processing section B is coupled to the sheet discharge outlet 18, and is configured to collate and collect image-formed sheets as a set, apply an adhesive to the back binding portion to bind in book form, cut and trim the edges as cut finish, and then, store the sheets in the storage stacker 57.

The image forming section A is capable of adopting various printing mechanisms as described above, and the electrostatic printing mechanism is shown as an example to describe the configuration. In the image forming section A as shown in the figure, inside a casing 1 are provided the paper feed section 2, printing section 3, sheet discharge section 4 and control section. The paper feed section 2 is provided with a plurality of cassettes 5 corresponding to the sheet sizes, and feeds a sheet of the size designated from the image formation control section 61 to a paper feed path 6. The paper feed path 6 is provided with a register roller 7, and after aligning the front end, feeds the sheet to the printing section 3 on the downstream side at predetermined timing.

The printing section 3 is provided with an electrostatic drum 8, and a printing head 9, developing device 10, transfer charger 11 and the like are disposed around the electrostatic drum 8. Then, for example, the printing head 9 is comprised of a laser emitter, an electrostatic latent image is formed on the electrostatic drum 8, the developing device 10 adds toner ink to the latent image, and the transfer charger 11 prints the image in the sheet. The printed sheet is fused by a fuser 12, and carried out to a sheet discharge path 13.

In the sheet discharge section 4 are disposed the sheet discharge outlet 18 formed in the casing 1 and sheet discharge roller 14. In addition, "15" shown in the figure denotes a circulating path, and is to reverse the side of the printed sheet from the sheet discharge path 13 via a switchback path 16, then feed the sheet to the register roller 7 again, and form an image on the backside of the printed sheet. The printed sheet with the image thus formed on one or two sides is carried out of the sheet discharge outlet 18 by the sheet discharge roller 14.

In addition, "C" shown in the figure is a scanner unit (document read section), and optically reads a document image to print using the printing head 9. As is generally known, the structure is comprised of a platen 19 for setting a document sheet, a carriage 20 for scanning the document image along the platen 19, and optical read means (for example, CCD device) 21 for performing photoelectric conversion on an optical image from the carriage 20. Further, in the scanner unit as shown in the figure, a document feeding apparatus 22 for automatically feeding a document sheet to the platen 19 is provided on the platen 19.

[Bookbinding Apparatus]

The bookbinding apparatus (post-processing section) B shown in FIG. 1 is configured to collate and collect sheets sent from the image forming section A to forma bunch of sheets, and perform bookbinding by either the bookbinding processing for applying an adhesive to the bunch of sheets (hereinafter, referred to as an "inside sheet bunch") to bind for grew binding, or to bind the inside sheet bunch to a front-cover sheet for cover bookbinding, or the bookbinding processing for binding the inside sheet bunch using a stapler apparatus (unit). In the apparatus as shown in the figure, the bookbinding processing for cover bookbinding is shown as an example.

As specifically shown in FIG. 5, the bookbinding apparatus (post-processing section) B is provided with a bookbinding path 30 for guiding an inside sheet bunch from an application position X to a front-cover binding position Y, and then, to a cut position Z. In the application position X is disposed an adhesive coating means 35 for applying an adhesive to a back binding end surface of the sheet bunch, and in the front-cover binding position Y is disposed a front-cover binding means 40 comprised of a back support plate 41 and a back folding plate 42.

Further, in the cut position Z is disposed a cutting unit 50 for cutting and trimming the outer edges of the bound sheet bunch. Then, the bookbinding path 30 is provided with a sheet bunch transport means 47 for carrying the inside sheet bunch from the application position X to the cut position Z along the path.

[Bookbinding Path]

The bookbinding path 30 will be described. As shown in FIG. 5, a casing 24 of the bookbinding apparatus (post-processing section) B is provided with a carry-in entrance 23 connected to the sheet discharge outlet 18 of the image forming section A, and a sheet is carried into the apparatus from the carry-in entrance 23. To a carry-in path P1 is coupled an inside sheet transport path P2 and a front-cover transport path P3 via a path switching flapper 27. Then, the bookbinding path 30 is coupled to the inside sheet transport path P2 via the collecting section 28.

As can be seen from FIG. 5, the bookbinding path 30 is disposed substantially in the vertical direction for traversing longitudinally the apparatus, and the front-cover transport path P3 is disposed substantially in the horizontal direction for traversing laterally the apparatus. Then, the bookbinding path 30 and front-cover transport path P3 cross each other (at right angles), and the front-cover binding means 40 described later is disposed at the intersection portion.

The image forming apparatus A feeds the printed sheet to thus configured carry-in path P1. The image forming apparatus A carries out printed sheets (inside sheets) with the content information (document data) printed therein and a printed sheet (front-cover sheet) with a title and the like printed therein used as a front cover. Then, the bookbinding apparatus (post-processing section) B allocates the sheet with the document data printed therein to the inside sheet transport path P2, and the sheet with the front-cover data printed therein to the front-cover transport path P3.

Meanwhile, an inserter apparatus 29 is coupled to the carry-in path P1, and is configured to separate front-cover sheets that do not undergo the printing processing in the image forming apparatus A on a sheet-by-sheet basis from a paper feed tray 29*a* and supply the sheet to the carry-in path P1. The inserter apparatus 29 is provided with the paper feed tray 29*a* with a single or plurality of stages, in the tray front end is provided a paper feed means for separating the loaded sheets on a sheet-by-sheet basis to feed, and a paper feed path P5 is provided on the downstream side of the paper feed means, and is coupled to the carry-in path P1 via a path switching piece 31.

Further, a transport roller 32 is disposed in the carry-in path P1, a transport roller 33 is disposed in the inside sheet transport path P2, and in the bookbinding path 30 are disposed the sheet bunch transport means 47, bunch attitude changing means 48, and sheet discharge roller 53. Similarly, a transport roller 34 is disposed in the front-cover transport path P3, and is coupled to a driving motor.

[Configuration of the Collecting Section]

The collection tray (collecting means) 26 is disposed in a sheet discharge outlet 36 of the inside sheet transport path P2, and stores sheets from the sheet discharge outlet 36 in bunch form. As shown in FIG. 5, the collection tray 26 is comprised of a tray member disposed substantially in the horizontal position, and a forward/backward rotation roller 37*a* and carry-in guide 37*b* are provided above the tray. Then, a printed sheet from the sheet discharge outlet 36 is guided onto the collection tray by the carry-in guide 37*b*, and stored by the forward/backward rotation roller 37*a*.

This forward/backward rotation roller 37*a* carries the printed sheet to the front end side of the collection tray 26 by forward rotation, while causing the sheet rear end to strike a regulation member 26*x* disposed in the tray rear end (right end as viewed in FIG. 5) to regulate. Further, a sheet side aligning means, not shown, is provided in the collection tray 26 to align in the width the opposite edges of the printed sheet stored on the tray. In such a configuration, the printed sheet from the inside sheet transport path P2 is sequentially stacked on the collection tray 26 and collated in bunch form.

A sheet bunch thickness identifying means, not shown, is provided in the collection tray 26, and detects a thickness of a bunch of sheets collected on the tray. As the configuration, for example, a paper contact piece contacting the uppermost sheet is provided on the tray, the position of the paper contact piece is detected by a sensor, and it is thereby possible to identify the thickness of the bunch of sheets.

Further, as the sheet bunch thickness identifying means, for example, a sheet discharge sensor Se3 detects a sheet carried onto the collection tray, a counter is provided which counts a signal from the sheet discharge sensor, the total number of sheets counted by a job finish signal from the image forming section A is multiplied by the average sheet thickness, and it is thereby possible to identify the thickness of the bunch of sheets.

[Sheet Bunch Transport Means]

The sheet bunch transport means 47, which transports the inside sheet bunch from the collection tray 26 to the application position X on the downstream side, grips the inside sheet bunch collected on the collection tray 26 using a pair of fixed clamper and movable clamper (not shown), changes the attitude of the sheet bunch from the horizontal direction to the vertical direction as shown in FIG. 5, and carries the sheet bunch to the downstream side along the bookbinding path 30. Although the configuration is not shown, since various grip transport mechanisms are already known, the description of the configuration is omitted.

[Adhesive Coating Means]

In the bookbinding path 30, the application position X is provided on the downstream side of the collection tray 26, and the adhesive coating means 35 is provided in the position X. As shown in FIG. 5, the adhesive coating means 35 is provided with a coating roll 44, for applying an adhesive to the back portion of the inside sheet bunch, supported by the sheet bunch transport means 47. The coating roll 44 is attached rotatably to an adhesive container 45, and is coupled to a coating motor Mr.

Further, the adhesive container 45 is supported by a guide rail 46 to reciprocate in the frontside/backside direction as viewed in FIG. 5. A timing belt not shown is looped over the adhesive container 45, and the container 45 is configured to reciprocate in a predetermined stroke by a driving motor Md.

Accordingly, the adhesive container 45 reciprocates in the predetermined stroke along the lower end edge of the inside sheet bunch positioned by the sheet bunch transport means 47 described later, and the coating roll 44 applies the adhesive to the lower end edge of the sheet bunch, while rotating by the coating motor Mr.

[Configuration of the Front-Cover Binding Means]

The front-cover binding means 40 is disposed in the front-cover binding position Y of the bookbinding path 30. As shown in FIG. 5, the front-cover binding means 40 is comprised of the back support plate 41, back folding plate 42 and folding roll 43. The front-cover transport path P3 is disposed in the front-cover binding position Y, and feeds a front-cover sheet from the image forming section A or inserter apparatus 29.

Then, the back support plate 41 is comprised of a plate-shaped member that backs up the front-cover sheet, and is disposed to be able to enter and withdraw from the bookbinding path 30. The inside sheet bunch is bound in the shape of an inverse T to the front-cover sheet supported by the back support plate 41. Then, the back folding plate 42 is comprised of a pair of left and right press members, and so as to perform back folding forming on the back portion of the front-cover sheet bound in the shape of an inverse T, is configured to move closer and separate to/from each other by a driving means not shown. Further, the folding roll 43 is comprised of a pair of rollers that press the sheet bunch subjected to the back folding forming to perform folding finish.

[Bunch Cutting Unit]

The cut position Z is set on the downstream side of the front-cover binding position Y, and the cutting unit 50 is disposed in the position Z. The cutting unit 50 is comprised of the bunch attitude changing means 48, cut edge press means 51 and cutting means 52.

[Bunch Attitude Changing Means]

The bunch attitude changing means 48 for positioning and setting the sheet bunch in the cut position Z is disposed on the downstream side of the folding roll 43. The bunch attitude changing means 48 shown in the figure is configured to change the top/bottom direction of the sheet bunch. The bunch attitude changing means 48 changes the sheet bunch covered with the front cover from the front-cover binding position Y to a predetermined attitude to feed to the cut position Z on the downstream side.

Therefore, as shown in FIG. 5, the bunch attitude changing means 48 is provided with grip rotary members 49*a*, 49*b* for griping and rotating the sheet bunch sent from the folding roll 43. As shown in FIG. 5, these grip rotary members 49*a*, 49*b* are provided in a unit frame 49*x* attached to an apparatus frame to be able to move up and down. Each of the grip rotary members 49*a*, 49*b* is bearing-supported rotatably by the unit frame 49*x* with the bookbinding path 30 therebetween, and one of the members, movable grip rotary member 49*b*, is supported to be able to shift in the sheet bunch thickness direction (the direction orthogonalized to the bookbinding path 30).

Then, the grip rotary members 49*a*, 49*b* are respectively provided with turn motors Mt1, Mt2 to change the attitude of the sheet bunch inside the bookbinding path. Further, the grip rotary member 49*b* on the movable side is equipped with a grip motor Mg that shifts in the left/right direction as viewed in FIG. 5.

Accordingly, the sheet bunch guided inside the bookbinding path 30 is gripped by the left and right grip rotary members 49*a*, 49*b*, and the attitude direction of the sheet bunch is changed by the turn motors Mt1, Mt2. For example, the sheet bunch that is carried in with the back portion on the lower side is turned 180 degrees, and the sheet bunch is fed to the sheet discharge roller 53 on the downstream side with the fore edge portion on the lower side. Further, the sheet bunch is rotated 90 degrees sequentially, each of the top, bottom and fore edge portion is changed to the lower side in the cut position Z on the downstream side, and it is thus possible to cut and trim three edge directions of the sheet bunch.

In addition, the grip rotary member 49*b* on the movable side is provided with a grip sensor (not shown), and it is configured that the sensor detects that the sheet bunch is reliably gripped between the left and right grip rotary members 49*a*, 49*b*, and that the grip rotary members 49*a*, 49*b* are driven to turn after the detection. Then, the unit frame 49*x* is capable of moving the sheet bunch up and down along the bookbinding path 30 by an up/down motor Ma. The reason is to transport and set the sheet bunch in the cut position Z in cutting the sheet bunch outer edge separately to trim, and set a cut width (cut amount) in the cut position Z by the feeding amount.

[Configuration of the Cutting Unit]

The cutting unit 50 is disposed on the downstream side of the bunch attitude changing means 48. As shown in FIG. 5, the cutting unit 50 is comprised of the cut edge press means 51 for pressing the cut edge of the sheet bunch against a blade receiving member 54 to support, and the cutting means 52. The cut edge press means 51 is formed of a press mechanism for pressing the cut edge of the sheet bunch against the blade receiving member 54 to hold, and is comprised of a pressing member for pressing the sheet bunch and a biasing means (not shown) for applying a pressing force to the pressing member.

The cutting means 52 is comprised of a cut blade 52*x* in the shape of a flat blade, and a cutter motor (driving means) Mc for driving the blade 52*x*. The cutting unit with such a configuration cuts and trims the edges of the sheet bunch subjected to the bookbinding processing in book form by a predetermined amount except the back portion.

As shown in FIG. 5, the cut blade 52*x* is a cutting edge in the shape of a flat blade, configured in the blade width longer than the sheet width, supported to be able to reciprocate between a waiting position spaced apart from the blade receiving member 54 and a cut position to come into contact with the blade receiving member 54, and is coupled to the cutter motor (driving means) Mc.

In the cut position Z is disposed the blade receiving member 54 in the position opposed to the cut blade 52*x*. The blade receiving member 54 is disposed opposite to the cut blade 52*x* with the sheets (bunch) therebetween, is fixed to the apparatus frame (not shown), and is made of soft rubber material and resin material (polypropylene resin in the member as shown in the figure).

[Sheet Discharge Configuration]

On the downstream side of the cut position Z are disposed the sheet discharge roller 53 and storage stacker 57. As shown in FIG. 5, the storage stacker 57 stores the sheet bunch in an upright position. Then, the storage stacker 57 is disposed in the casing 24 in the shape of a drawer, and is configured to be capable of being pulled out to the apparatus front side (the frontside in FIG. 5). The operator is able to visually check from the upper direction with the stacker 57 pulled out to the apparatus front side. In addition, "57Sf" shown in the figure is a full detection sensor, detects the full state of sheet bunches stored in the storage stacker 57, and alerts the operator to the removal.

[Configuration of the Control Means]

Figure 7:
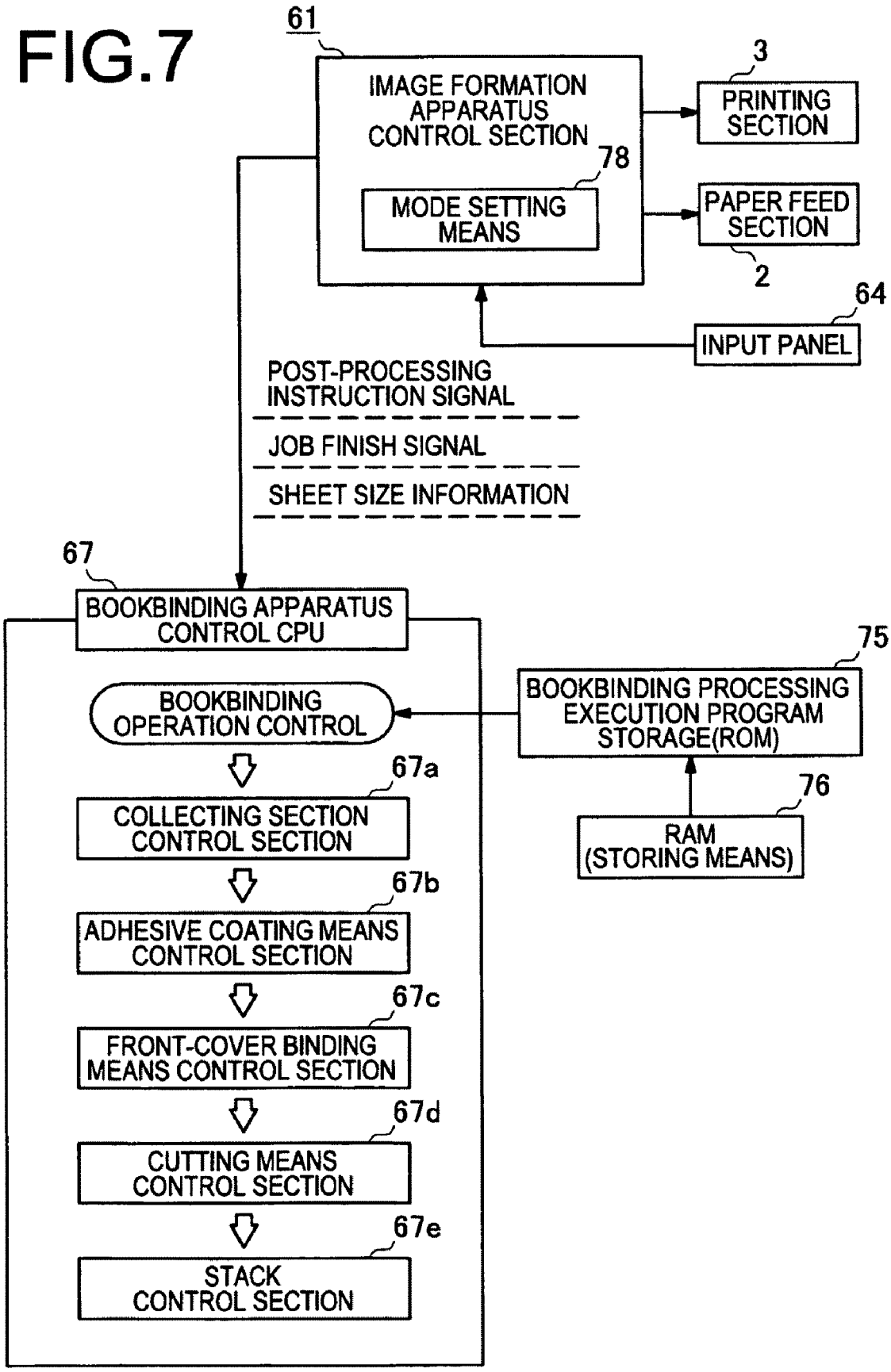
FIG. 7 is a configuration diagram of bookbinding operation control in the apparatus of FIG. 1.

Described next is the control configuration of the image formation system as shown in FIG. 1. FIG. 7 shows the control configuration, where the image formation control section 61 provided in the image forming section A is provided with the input panel 64 and mode setting means 78. Then, the post-processing control section 65 of the bookbinding apparatus (post-processing section) B is provided with the control CPU 67, and the control CPU 67 reads a bookbinding processing execution program from the ROM 70 to execute each processing in the bookbinding path 30.

Further, the control CPU 67 receives the post-processing mode designation signal, job finish signal, sheet size information, other information required for bookbinding and command signals from the control CPU 63 of the image forming section A. Meanwhile, the sheet sensors Se1 to Se5 for detecting the sheet (sheet bunch) to transport are disposed in respective positions as shown in FIG. 5 in the carry-in path P1, bookbinding path 30 and front-cover transport path P3.

Then, the detection signal of each of the sheet sensors Se1 to S5 is conveyed to the control CPU 67, and the control CPU 67 is provided with the "collecting section control section 67*a*", "adhesive coating means control section 67*b*", "front-cover binding means control section 67*c*", "cutting means control section 67*d*", and "stack control section 67*e*".

In addition, in the invention, shown is the case where the post-processing section B applies an adhesive to a bunch of sheets to perform cover bookbinding with a front-cover sheet, but for example, the post-processing section B may be a configuration that a stapler unit is provided in the collection tray 26 to staple a bunch of sheets collected on the tray, or similarly a configuration that a puncher unit is provided in the collection tray 26 to punch filing holes in the collected bunch of sheets.

Figure 4A:
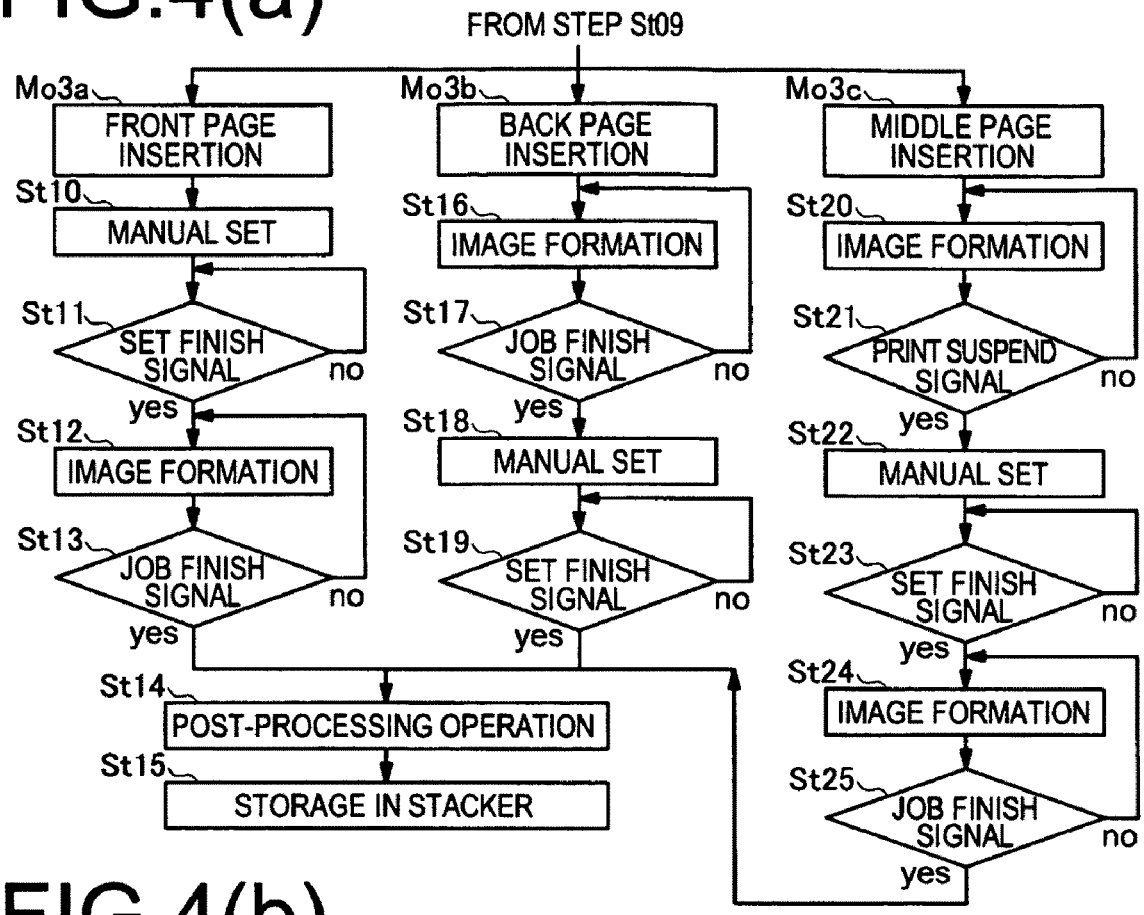
FIG. 4(*a*) shows an operation flow of a mixing post-processing mode.
Figure 4B:
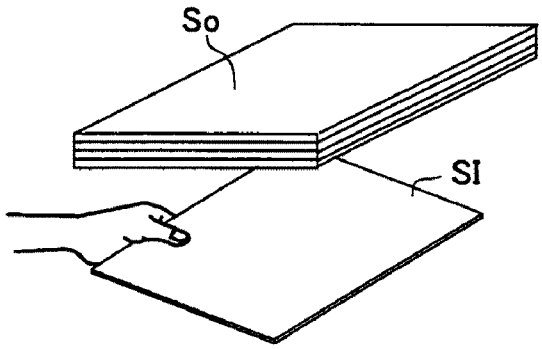
Figure 4D:
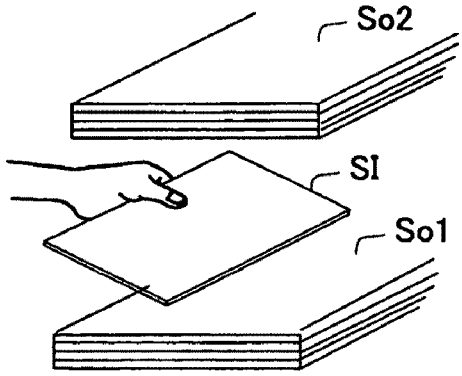
Figure 4C:
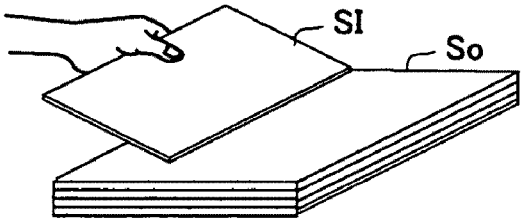
Figure 8:
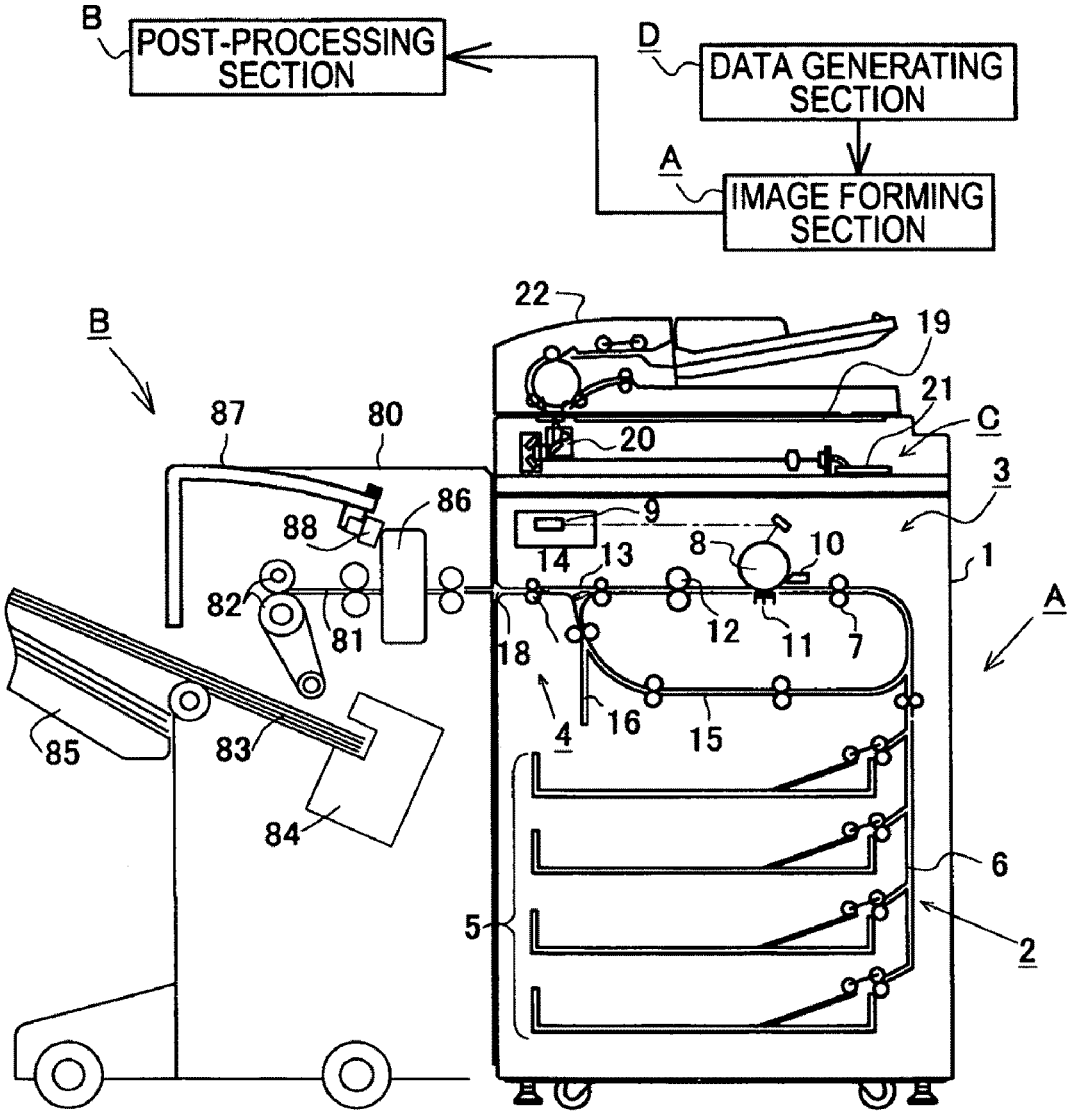
FIG. 8 is a configuration diagram of a post-processing system different from the apparatus of FIG. 1.

FIG. 8 shows a system equipped with a stapler unit 84 as the post-processing section B. The image forming section A has the same structure as shown in FIG. 4A, and the same reference numerals are assigned to omit descriptions thereof. In the post-processing section B, an apparatus housing 80 is provided with a post-processing path 81 to carry in a sheet from the image forming section A, and the post-processing path 81 is provided with a sheet discharge roller 82. A height difference is formed on the downstream side of the sheet discharge roller 82, a collection tray 83 is disposed therein, and sheets sent to the post-processing path 81 are loaded and stored on the tray.

A stapler unit 84 is disposed in the collection tray 83. Further, not shown in the figure, the collection tray 83 is provided with a conveyer mechanism for carrying out a bunch of sheets subjected to stapling to a storage stacker 85. In addition, "86" shown in the figure denotes a punch unit that punches filing holes in a sheet sent to the post-processing path 81.

Further, the collection tray 83 is provided with an open/close cover 87 disposed in the apparatus housing 80 to be able to open and close, and the open-close cover 87 is provided with a detection sensor 88. Then, in the same way as shown in FIG. 4, the stapler unit 84 binds a sheet bunch manually set on the collection tray 83 including image-formed sheets from the image forming section A, and the sheet bunch is collected in the storage stacker 85.

In addition, this application claims priority from Japanese Patent Application No. 2010-074973 incorporated herein by reference.

What is claimed is:

1. A post-processing system comprising:

an image forming section that forms an image on a sheet;

a post-processing section that performs post-processing on sheets with images formed thereon, including a collecting device for setting the sheets in a bunch form, a sheet transport device for carrying the sheet with the image formed in the image forming section to the collecting device, a post-processing device for performing the post-processing on a bunch of sheets, and a stack device for holding the bunch of sheets subjected to the post-processing; and a control section that controls the image forming section and the post-processing section, including a mode selecting device for alternatively selecting an automatic post-processing mode in which the post-processing section performs the post-processing on the bunch of sheets comprising the sheets with images formed in the image forming section and set in the collecting device by the sheet transport device, or a mixing post-processing mode in which the post-processing section performs the post-processing on a bunch of mixed sheets comprising the sheets sent to the collecting device from the image forming section by the sheet transport device and a sheet manually set in the collecting device from an outside, and an operating device for outputting a set finish signal when manually setting the sheet in the collecting device is finished, wherein the control section is configured to perform the post-processing on the bunch of sheets in the post-processing device on a condition that, in the automatic post-processing mode, a print job finish signal is output from the image forming section when image formation is finished, or a condition that, in the mixing post-processing mode, after the image formation is suspended in the image forming section, a sheet is manually set in the collecting device, and after completion of the manually setting the sheet, the set finish signal is output from the operating device.

2. The post-processing system according to claim 1, wherein the post-processing section further comprises an opening and closing cover to set the bunch of sheets in the collecting device from the outside, and the operating device has a switching device that is actuated by operation of opening and closing the opening and closing cover.

3. The post-processing system according to claim 1, wherein the control section further comprises a manual post-processing mode for performing the post-processing on the bunch of sheets manually set in the collecting device in the post-processing section, as well as the automatic post-processing mode and the mixing post-processing mode.

4. The post-processing system according to claim 1, wherein the mode selecting device is configured to be able to set an order of the mixed sheets comprising the sheet manually set and the sheets from the image forming section in the collecting device, in the mixing post-processing mode.

5. The post-processing system according to claim 4, wherein when the order of the mixed sheet is set so as to further set the sheets from the image forming section in the collecting device after the sheet is manually set, the control section is configured to perform the post-processing on the bunch of sheets in the post-processing device on a condition that the print job finish signal is further output from the image forming section after the set finish signal is output from the operating device.

6. The post-processing system according to claim 1, wherein the post-processing device has a sheet bunch binding device disposed in the collecting device.

7. The post-processing system according to claim 1, wherein the post-processing device further includes a bookbinding device for bookbinding the bunch of sheets set on the downstream side of the collecting device.

8. The post-processing system according to claim 1, wherein the post-processing section further comprises an inserter device coupled to the sheet transport device so as to separately supply a sheet from the outside in the collecting device.

* * * * *